US007490830B2

(12) United States Patent
Mirandette et al.

(10) Patent No.: US 7,490,830 B2
(45) Date of Patent: Feb. 17, 2009

(54) MULTI-TICKET LOTTERY SYSTEM

(75) Inventors: Benoit Mirandette, Lachenaie (CA); Michel Paris, Montreal (CA); Daniel Lacharite, Varennes (CA); Myriam Giasson, Deux-montagnes (CA)

(73) Assignee: Oberthur Gaming Technologies, Inc., Montreal, Quebec (CA)

( * ) Notice: Subject to any disclaimer, the term of this patent is extended or adjusted under 35 U.S.C. 154(b) by 89 days.

(21) Appl. No.: 11/000,624

(22) Filed: Dec. 1, 2004

(65) Prior Publication Data

US 2005/0194735 A1 Sep. 8, 2005

(51) Int. Cl.
*A63F 3/06* (2006.01)

(52) U.S. Cl. ..... 273/139; 283/903

(58) Field of Classification Search ..... 273/139, 273/269; 283/903
See application file for complete search history.

(56) References Cited

U.S. PATENT DOCUMENTS 5,046,737 A * 9/1991 Fienberg ..... 273/139
5,076,612 A * 12/1991 Nirmel ..... 283/67
5,286,061 A * 2/1994 Behm. William F. ..... 283/95
5,407,200 A * 4/1995 Zalabak ..... 273/139
5,657,991 A * 8/1997 Camarato ..... 273/269
5,743,524 A * 4/1998 Nannicola ..... 273/139
5,934,671 A 8/1999 Harrison
6,041,929 A * 3/2000 Brunner et al. ..... 206/459.5
6,102,395 A * 8/2000 Such ..... 273/139
6,220,961 B1 4/2001 Keane et al.
6,542,184 B1 4/2003 Driscoll, Jr. et al.
6,581,935 B1 * 6/2003 Odom ..... 273/269
6,612,576 B1 * 9/2003 Stancik et al. ..... 273/139
6,698,755 B2 * 3/2004 Cherry ..... 273/139
6,824,135 B2 * 11/2004 Stancik ..... 273/139
6,923,440 B2 * 8/2005 Cherry ..... 273/139
7,033,271 B2 * 4/2006 Gerow ..... 463/17
7,128,319 B2 * 10/2006 Finocchio ..... 273/139

* cited by examiner

*Primary Examiner*—William M Pierce
(74) *Attorney, Agent, or Firm*—Dority & Manning, P.A.

(57) ABSTRACT

A multiple ticket lottery system in which a player engages in one or more play actions on a first lottery ticket level in order to gain access to a second or higher ticket level in order to win a prize.

15 Claims, 3 Drawing Sheets

MULTI-TICKET LOTTERY SYSTEM

FIELD OF THE INVENTION

The present invention is directed to a multiple ticket lottery system in which a first level of lottery ticket is played and a desirable goal is to gain access to a second level lottery ticket or even higher level lottery ticket. Access may be gained by collecting a pre-set number of collectibles from the first level lottery ticket and/or by uncovering a direct access indicia which enables the player to proceed to the second or even higher level. Access to exceedingly higher levels of lottery tickets may result in the possibility of winning prizes of increasing value.

BACKGROUND OF THE INVENTION

Lottery tickets are a very popular source of entertainment offering the possibility of winning a prize. Traditional scratch-off lottery tickets are played by removing a scratch-off layer from the lottery ticket to reveal a series of indicia wherein the presence of certain patterns or types of indicia can result in the winning of a prize. While such tickets remain popular, a recent development in the lottery industry is to provide a play action such as a game as part of a lottery ticket that provides an additional source of amusement.

It is therefore an object of the present invention to provide a multiple lottery ticket system in which valuable prizes may be won and which the player plays a multiple ticket lottery play action game which extends from one level of a lottery ticket to another level of a lottery ticket. Another object of the present invention is to proceed to as high a lottery ticket level as possible to increase the possibility of winning a valuable prize.

SUMMARY OF THE INVENTION

The present invention is generally directed to a multiple ticket lottery system in which one of the objects of the system is to reach as high a level as possible to increase the chances of winning a prize or a higher value prize. The multiple ticket lottery system includes at least two lottery ticket levels which are integrated in a manner in which they are included in the same play action game which is to gain access to as high a lottery ticket level as possible.

In a particular aspect of the present invention, there is provided a multiple ticket lottery system comprising at least two lottery ticket levels, a first ticket level having at least one region selected from a collectible generating region and a direct access region. The collectible generating region is comprised of an area which contains at least one collectible item wherein a collection of a pre-set number of the collectible items entitles the player to proceed to play the second or higher lottery ticket level. The direct access region, contains play indicia in which if a certain winning play indicia or pattern of play indicia is present, enables the player to proceed automatically to the second or higher lottery ticket level, wherein access to the second or higher lottery ticket level or higher level may result in a prize being won or the winning a prize of higher value.

Additional lottery ticket levels may be provided within the scope of the present invention thus providing a progressive multiple ticket lottery system wherein one of the objects of the invention is to reach the highest level to increase the chances of winning a prize or winning a higher value prize.

BRIEF DESCRIPTION OF THE DRAWINGS

The following drawings in which like reference characters indicate like parts is illustrative of an embodiment of the present invention and is not intended to limit the invention as encompassed by the claims forming part of the application.

DETAILED DESCRIPTION OF THE INVENTION

The present invention is generally directed to a multiple ticket lottery system in which multiple levels are employed in the form of lottery tickets wherein an object of the system is for the player to proceed to the highest level in order to increase the chances of winning a prize or a higher value prize. In accordance with one embodiment of the present invention, reference is made to FIG. 1 which is exemplary of the present invention and depicts in this specific embodiment a three level lottery ticket system. It will be understood that two or more lottery ticket levels are required for the present multiple lottery ticket system and that more than the three lottery ticket levels shown in FIG. 1 may be employed.

Figure 1:
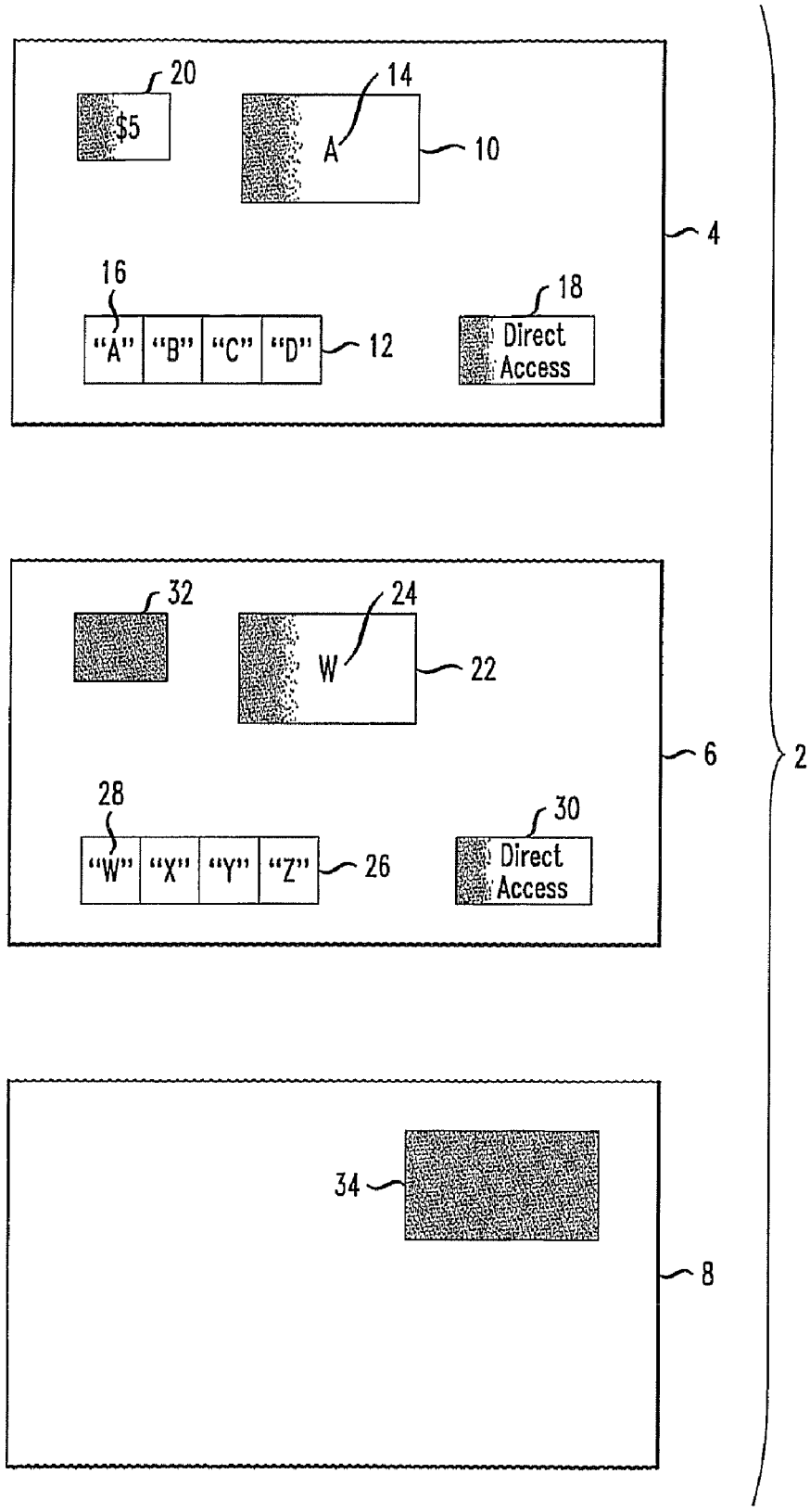
FIG. 1 is a top plan view of a three level multiple ticket lottery system in accordance with the present invention.

Referring to FIG. 1, the lottery system 2 comprises three levels 4, 6 and 8 in the form of separate lottery tickets which include a substrate, game areas as hereinafter described and printed graphics to enhance the appearance of the lottery ticket and to promote, perhaps, a particularly theme of the lottery ticket (e.g. a holiday ticket). Typically each level of the lottery ticket system will provide instructions for playing the game. In addition, instructions for playing the lottery system and the different levels may be provided on point of purchase displays and the like.

The three level lottery ticket system provides a play action in which all three levels are integrated so that an object of the present invention is to reach the highest level (e.g. the third level) by passing through one or both of the first and second lottery ticket levels. The first level lottery ticket 4 comprises at least one region which (if successfully completed) will enable the player to gain access to the second level lottery ticket 6. The second level lottery ticket will likewise provide at least one way by which the player can gain access to the third (and, in this example, the highest) lottery ticket level 8, thus creating an integrated play action between all levels of the lottery ticket system. Access to succeeding higher levels can be in a variety of ways including completion of a collectible region, or by an appropriate symbol in a direct access region or an instant win region of the lottery ticket or combination thereof and the like.

In the embodiment shown in FIG. 1, the first level lottery ticket 4 includes a game region designated as a first collectible generating region 10. The collectible generating region 10 will contain any indicia, icon, picture, graphic or the like which can be collected and associated with the second level lottery ticket 6 or a higher level lottery ticket (e.g. a third level lottery ticket 8) in a corresponding game region designated as a first collectible receiving region 12.

The first collectible generating region 10 on the first lottery ticket level 4 is covered by a standard scratch-off layer which when removed reveals one or more particular indicia or icons, for example, which may find correspondence in the first collectible receiving region 12. As shown specifically in FIG. 1, a portion of the scratch-off layer has been removed to reveal a first level collectible indicia 14 in the form of the letter "A". If the collectible indicia 14 finds correspondence in the first collectible receiving region 12 appearing in the first lottery ticket level 4, then the player has collected one of the collectible indicia 14 necessary to complete the first collectible receiving region 12. As specifically shown in FIG. 1, the first collectible receiving region 12 contains, for example, spaces for four collectible items. The four collectible items generally designated by the numeral 16, if collected, entitles the player to proceed to the second lottery ticket level 6 with the opportunity to play the second level type of ticket to optionally gain access to the third level lottery ticket designated by the numeral 8. The player can therefore purchase level one lottery tickets 4 until all the collectible indicia 14 which find correspondence in the first collectible receiving region 12 (i.e. collectible items 16) are obtained.

Figure 2A:
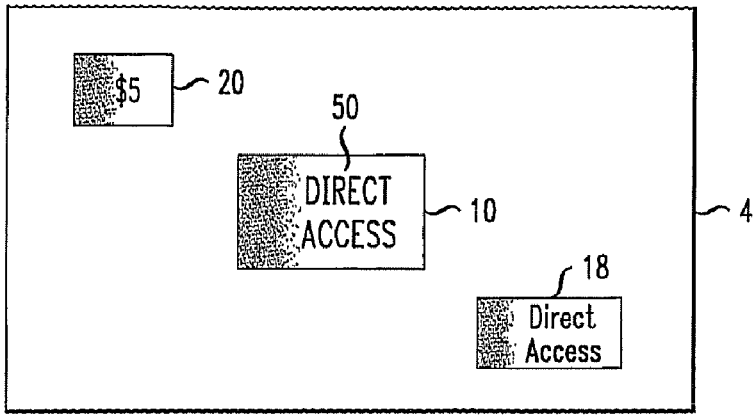
FIG. 2A is a top plan view of the first lottery ticket level of the lottery ticket shown in FIG. 1 showing a direct access symbol in the collectible generating region.
Figure 2B:
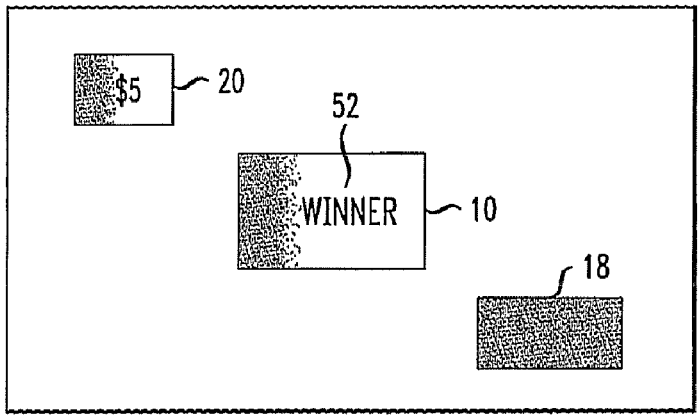
FIG. 2B is a top plan. view of the first lottery ticket level of the lottery ticket shown in FIG. 1 showing an instant win symbol in the collectible generating region.
Figure 2C:
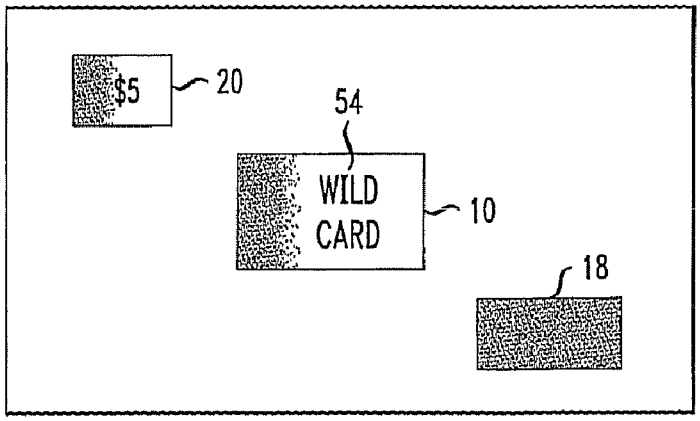
FIG. 2C is a top plan view of the first lottery ticket level of the lottery ticket shown in FIG. 1 showing a wild card symbol in the collectible generating region.

The first collectible generating region 10 may also contain in addition to the collective indicia 14, as shown in FIGS. 2A and 2C, a direct access symbol 50 or a wild card symbol 54 which either enables the player to proceed directly to the second lottery ticket level 6 or higher level or facilitates entry thereto. For example, and referring to FIG. 2A, the collectable generating region 10 shows a direct access indicia 50 which entitles the player to forego completing the requirements of the first collectible receiving region 12 and proceed directly to the second level lottery ticket level 6. As an alternative, and as shown in FIG. 2B, the first collectible generating region 10 may include an instant win feature which may include the instant winning of a cash prize and/or direct access to a higher level lottery ticket.

In a still further embodiment of the invention, the first collectible generating region 10 may contain a "wild card" designation. This entitles the player to designate the wild card as any collectible item which may be required in the first collectible receiving region 12. As shown in FIG. 2C, the wild card symbol is identified by numeral 54.

Another method of proceeding from the first lottery ticket level 4 to the second lottery ticket level 6 is through an optional direct access region 18 which may contain, below the scratch-off layer, an indication that the player gains automatic access to the second lottery ticket level 6. As specifically shown in FIG. 1, the direct access region 18 is shown with a portion of the scratch-off layer removed which provides the direction "direct access to level two" which automatically entitles the player to gain access to a level two lottery ticket 6 without necessarily having completed the collectible items 16 required in the first collectible receiving region 12. In this way, the player has another means by which to gain access to the second level ticket 6.

Figure 3A:
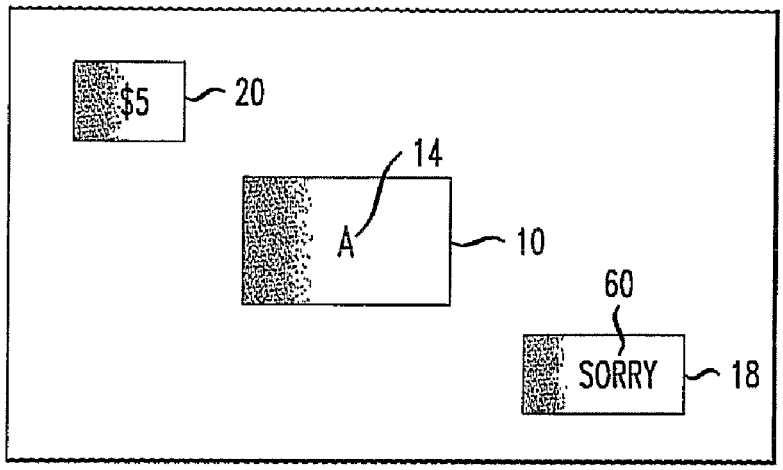
FIG. 3A is a top plan view of the first lottery ticket level of the lottery ticket shown in FIG. 1 showing a prize defeating symbol in the direct access region.

The direct access region 18 may optionally contain an instant prize winning symbol (e.g. win $5) and/or be used to increase the risk of playing the multi-ticket lottery game or to enhance the value of a prize. For example, the direct access region 18 may include a prize defeating symbol 60 (e.g. "sorry") as shown in FIG. 3A. If the player chooses to play the direct access region 18 and the prize defeating symbol 60 appears, the player may lose any prizes that may previously have been won or may be required to terminate the game.

Figure 3B:
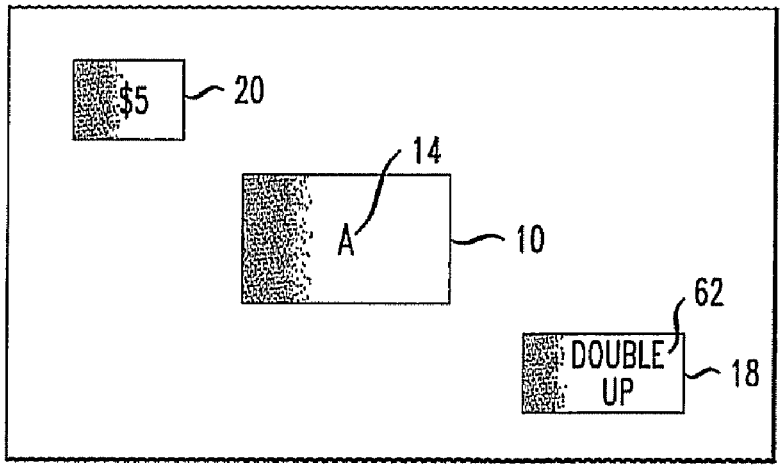
FIG. 3B is a top plan view of the first lottery ticket level of the lottery ticket shown in FIG. 1 showing a prize enhancing symbol in the direct access region.

The direct access region 18 may in addition or alternatively be used to enhance the value of a prize by an indicia 62 such as the designation "double up" which may indicate that any prize which may be won is now doubled in value. This embodiment of the invention is shown in FIG. 3B.

The risk features including prize defeating symbols 60 and prize enhancing symbols 62 may be incorporated into the multi-level lottery system through the technology disclosed in U.S. Provisional Patent Application Ser. No. 60/471,786 filed May 20, 2003, incorporated herein by reference. In particular, there may be provided a prize risk regions which contains prize affecting indicia covered by a scratch-off layer which can be in the form of a prize enhancing indicia, a prize reducing indicia including the entire elimination of the prize and a "no change" form of indicia in which the value of the prize does not actually change but the player must determine whether to risk the value of that prize by playing the prize risk region whereby the value of the prize may increase, decrease, be eliminated or not changed.

The first lottery ticket level 4 may optionally contain a play region 20 which can be a separate game such as used in a standard lottery ticket or provide an instant win feature by which the player can obtain a prize at the first level lottery ticket 4. As shown in FIG. 1, a portion of the scratch-off layer of the play region 20 has been removed to reveal an instant win prize of $5. Thus, in one embodiment of the present invention, the level one lottery ticket 4 provides not only the progressive feature of gaining access to the next highest level (second lottery ticket level 6) but also provides a conventional play action for winning a prize similar to what the player would expect to find on a conventional scratch-off type lottery ticket. Alternatively, the lottery system 2 may require the player to separately purchase a higher level lottery ticket (e.g. second level lottery ticket 6). Thus, the player may purchase the first level lottery ticket 4 so as to play the game associated with play region 20 without having to purchase higher level tickets.

The second level lottery ticket 6 includes a second collectible generating region 22 where collectible indicia 24 may be matched with collectible items 28 contained in and a second collectible receiving region 26 which is very similar to the first collectible receiving region 12 found on the first lottery ticket level 4. The second collectible generating region 22 may contain a collectible indicia 24 shown as letter "W" which will be used to fill a corresponding collectible receiving region 26 (i.e. second collectible receiving region) found on the second level lottery ticket 6 which may include a direct access feature or an instant win feature or a wild card feature as described above in connection with the first collectible generating region 10 and as shown in FIGS. 2A-2C. The second collectible receiving region 26 will provide spaces for collecting collectible items 28 which as shown specifically in FIG. 1 which are the items represented by the letters W, X, Y and Z. In accordance with the rules of the multiple lottery ticket system, the completion of the second collectible receiving region 26 containing all collectible items 28 will result in access to the next highest lottery ticket level.

Access to the third level lottery ticket 8 may also be made by a direct access feature in the form of a direct access region 30 which functions similar to the direct access region 18 appearing on the first level lottery ticket 4 as described and shown connection with the direct access region 18 shown in FIGS. 1, 3A and 3B. If the player has possession of a second lottery ticket level 6 with direct access to the third lottery ticket level 8 appearing in the direct access region 30, then the player automatically proceeds to the third level lottery ticket 8 and may be guaranteed of winning a prize. It will be understood that the direct access region 30 may also contain a play action game or prize winning indicia enabling the player to instantly win a prize.

In addition to the features of the second lottery ticket level 6 ticket which provide access to the third lottery level ticket 8, the second level ticket 6 may also provide a play region 32 having a similar function to the play region 20 appearing in the first level lottery ticket 4. A conventional lottery game or instant win feature can be provided in this region to provide added incentive for the player to reach the second level lottery ticket.

In playing the multiple ticket level lottery system of the present invention, the player purchases one or more first level lottery tickets 4 with the hope of gaining access to a second level lottery ticket 6 which the player may be required to purchase. To gain access to the second level lottery ticket, the player must collect all of the collectible items 16 required in the first collectible receiving region 12 which may be completed by purchasing a sufficient number of first level tickets 4 to obtain the individual collectible indicia 14 obtained from the first collectible generating region 10. If the player can complete the second collectible receiving region 12, access to the second lottery ticket level is successfully completed. Alternatively, if the player is fortunate to obtain a first level lottery ticket 4 which has the necessary indicia appearing in the direct access region 18 or elsewhere as in the first collectible generating region 10, then the player need not collect all of the collectible items but has the right to obtain a second level lottery ticket 6 with or without charge depending on the rules of the particular game.

Access to the second level lottery ticket 6 enables the player to collect the collectible indicia 24 appearing in the second collectible generating region 22 until all of the collectible items 28 appearing in the second collectible receiving region 26 are obtained so that the player can gain access to the third level lottery ticket 8 and be guaranteed of winning a prize. As previously indicated, direct access to the third level lottery ticket 8 can be obtained through the direct access region 30 if it contains the necessary direct access indicia.

Access to the third level lottery ticket 8 may automatically result in the player winning a prize. In this regard, the third level lottery ticket 8 may contain a play region 34 covered by a scratch-off layer which contains information relevant to the prizes the player has won for reaching the third level lottery ticket. Alternatively, the play region 34 may contain a game which must successfully be played by the player in order to win a prize for reaching the third lottery ticket level.

It will be understood in accordance with the present invention that two levels are required to play the multiple level lottery ticket system of the present invention but that more than two levels can be provided. Typically, the more levels that are provided in the lottery ticket system of the present invention, the higher the value of the automatic prize when one reaches the highest level.

Instructions for playing the multi-level lottery game may be printed on the lottery ticket and/or at point of sale displays and the like. The instructions typically will include a list of collectibles that must be collected in the collectible receiving region to win a prize or gain access to the next highest lottery ticket level. By way of example and referring to FIG. 1, instructions for playing the first level lottery ticket 4 may be placed on the front or back of the ticket 4 including what collectibles 14 are needed to complete the first collectible receiving region 12. Likewise, instructions may be printed on the second level lottery ticket 6 (front or back of the ticket) including the collectibles 24 needed to complete the second collectible receiving region 26.

What is claimed is:

1. A lottery ticket system which comprises at least two lottery tickets levels with each lottery ticket level represented by a separate lottery ticket, a first lottery ticket level comprising at least two first lottery tickets having a collectible receiving region containing a plurality of at least one target collectible items and a collectible generating region containing at least one collectible item therein wherein up to all of the collectible items in the collectible generating region are target collectible items, a portion of the first lottery tickets containing less target collectible items in the collectible generating region than the number of target collectible items in the collectible receiving region so that the player can not complete the collectible receiving region using only the target collectible items in the collectible generating region of a single first lottery ticket wherein the collection of a preset number of the target collectible items in the collectible receiving region entitles the player to proceed to play a second lottery ticket level, and a highest lottery ticket level comprising lottery tickets having a play region containing information relevant to a prize the player may have won for reaching the highest lottery ticket level, wherein the second lottery ticket level may be the highest lottery ticket level.

2. The lottery ticket system of claim 1 wherein the first ticket further comprises an instant win region containing play indicia wherein if the play indicia is an instant win play indicia the player is entitled to a prize.

3. The lottery ticket system of claim 2 wherein the instant win region may contain indicia enabling the player to proceed to another lottery ticket.

4. The lottery ticket system of claim 1 wherein the collectible generating region includes a symbol which represents any targeted collectible item.

5. The lottery ticket system of claim 1 wherein the collectible generating region includes at least one symbol selected from a direct access symbol, an instant win symbol and a wild card symbol.

6. The lottery ticket system of claim 1 further comprising a prize enhancing symbol which enhances the value of any prizes that may be won.

7. The lottery ticket system of claim 1 further comprising a prize risk region comprising a prize enhancing symbol, a prize defeating symbol or a no change symbol.

8. The lottery ticket system of claim 1 wherein at least the second lottery ticket comprises a collectible generating region and a collectible receiving region.

9. The lottery ticket system of claim 8 wherein the second lottery ticket further comprises an instant win region containing play indicia wherein if the play indicia is an instant win play indicia, the player is entitled to a prize.

10. The lottery ticket system of claim 9 wherein the instant win region contains indicia enabling the player to proceed to another lottery ticket.

11. The lottery ticket system of claim 8 wherein the collectible generating region of the second lottery ticket includes a symbol which represents any collectible item.

12. The lottery ticket system of claim 1 wherein the collectible generating region of the second lottery ticket includes at least one symbol selected from a direct access symbol, an instant win symbol and a wild card symbol.

13. The lottery ticket system of claim 1 comprising three lottery levels.

14. The lottery ticket system of claim 1 comprising a play region containing a game which if successfully played will result in the player winning a prize as a result of reaching the highest lottery ticket level.

15. The lottery ticket system of claim 1 wherein the first lottery ticket further comprises a direct access region containing at least one direct access play indicia enabling the player to proceed to the second lottery ticket level.

* * * * *